US006786700B2

(12) United States Patent
Taylor

(10) Patent No.: US 6,786,700 B2
(45) **Date of Patent: *Sep. 7, 2004**

(54) VAPOR EVACUATION DEVICE

(76) Inventor: Ernest Taylor, 340 Florida St., Baton Rouge, LA (US) 70801

( * ) Notice: Subject to any disclaimer, the term of this patent is extended or adjusted under 35 U.S.C. 154(b) by 101 days.

This patent is subject to a terminal disclaimer.

(21) Appl. No.: 10/087,326

(22) Filed: Mar. 1, 2002

(65) Prior Publication Data

US 2003/0165387 A1 Sep. 4, 2003

(51) Int. Cl.[7] ..... F04B 19/24

(52) U.S. Cl. ..... 417/53; 417/234; 417/151; 417/182

(58) Field of Search ..... 417/234, 151, 417/182, 187, 54, 53

(56) References Cited

U.S. PATENT DOCUMENTS

| | | | | | |
|---|---|---|---|---|---|
| 509,400 | A | * | 11/1893 | Ruble | 417/151 |
| 3,544,010 | A | * | 12/1970 | Jurdye | 239/168 |
| 3,823,872 | A | * | 7/1974 | Frenzl | 239/8 |
| 3,825,045 | A | | 7/1974 | Bloomquist | |
| 3,872,899 | A | | 3/1975 | Knight | |
| 3,902,874 | A | | 9/1975 | McAndrew | |
| 4,009,985 | A | | 3/1977 | Hirt | |
| 4,137,943 | A | | 2/1979 | Rath | |
| 4,469,143 | A | | 9/1984 | Vazin | |
| 4,545,739 | A | * | 10/1985 | Nicodemus | 417/152 |
| 4,580,948 | A | * | 4/1986 | Schmidlin | 417/54 |
| 4,616,979 | A | * | 10/1986 | Hynes et al. | 417/231 |
| 4,673,335 | A | * | 6/1987 | Nicodemus | 417/54 |
| 4,725,201 | A | * | 2/1988 | Nicodemus | 417/54 |
| 4,773,827 | A | * | 9/1988 | Zaiser | 417/183 |
| 4,781,537 | A | * | 11/1988 | Nicodemus et al. | 417/54 |
| 5,462,078 | A | | 10/1995 | Andenmatten et al. | |
| 5,878,767 | A | | 3/1999 | Etling et al. | |
| 6,019,820 | A | * | 2/2000 | Leverett | 95/216 |
| 6,109,882 | A | * | 8/2000 | Popov | 417/53 |
| 6,155,794 | A | * | 12/2000 | Wu | 417/151 |
| 6,164,567 | A | * | 12/2000 | Popov | 239/428.5 |
| 6,364,628 | B1 | * | 4/2002 | Potts et al. | 417/234 |

* cited by examiner

*Primary Examiner*—Justine R. Yu
*Assistant Examiner*—William H. Rodriguez
(74) *Attorney, Agent, or Firm*—Roy, Kiesel, Keegan & DeNicola

(57) ABSTRACT

A vapor evacuating device that enables product offloaders to quickly, easily, and safely offload chemicals and the associated vapors from vessels with minimal environmental impact and inconvenience by combining vapors from a tanker vehicle with an evacuation fluid, such as water, in order to yield a solution that is easily and safely disposed.

45 Claims, 4 Drawing Sheets

VAPOR EVACUATION DEVICE

BACKGROUND OF THE INVENTION

The present invention relates to the evacuation of hazardous and/or harmful vapors from a tanker vehicle. These vapors are typically vented into the atmosphere where they can cause environmental problems, or stored in the tanker vehicle where they can pose a danger, especially if they are flammable and/or volatile.

OBJECTS OF THE INVENTION

One object of the invention is to provide a vapor evacuation device that can evacuate vapors from tanker vehicles.

Another object of this invention is to provide a vapor evacuation device which combines harmful vapors into an easily disposable liquid and/or air stream.

Still another object of the invention is to provide a vapor evacuation device which is portable.

Other objects and advantages of this invention shall become apparent from the ensuing descriptions of the invention.

SUMMARY OF THE INVENTION

According to the present invention, the vapor evacuation device comprises at least one fluid line which can have a pump configured to draw a water and/or air mixture which is combined with vapors vacuumed from a tank via another inlet, yielding a solution that can then be disposed as a liquid. Vacuum at the inlet is created by the flowing of the water or air/water mixture past the inlet. The reduced pressure of the moving liquid causes a pressure differential with the higher pressure within the tank, and thus the vapors migrate into the vapor evacuation assembly, are mixed with the fluid, and can then be disposed.

BRIEF DESCRIPTION OF THE DRAWINGS

The accompanying drawings illustrate an embodiment of this invention. However, it is to be understood that this embodiment is intended to be neither exhaustive, nor limiting of the invention. They are but examples of some of the forms in which the invention may be practiced.

DETAILED DESCRIPTION OF EXEMPLARY EMBODIMENTS

Figure 1:
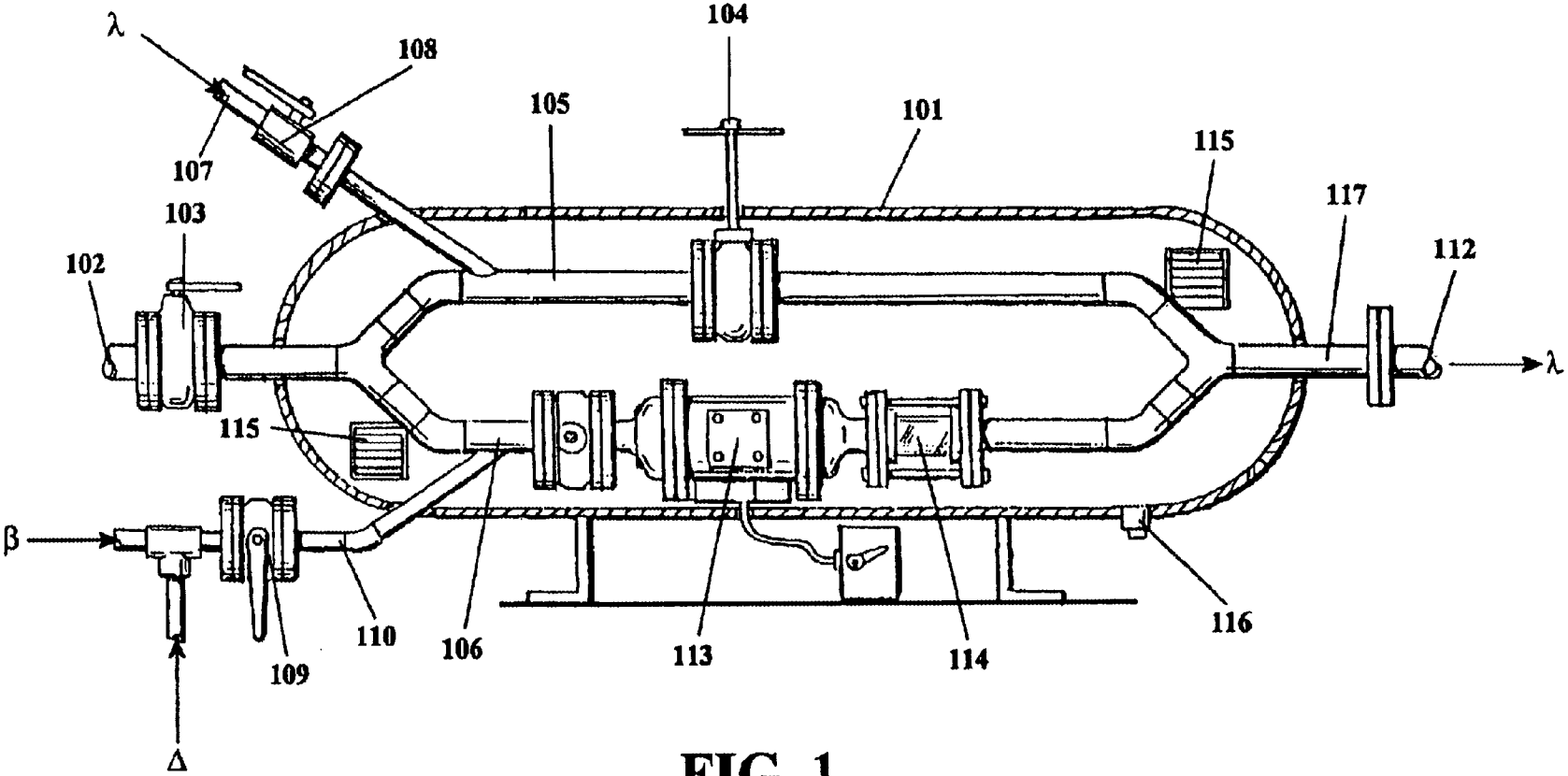
FIG. 1 shows a diametrical longitudinal cross section of an exemplary embodiment of a vapor evacuation device.
Figure 2:
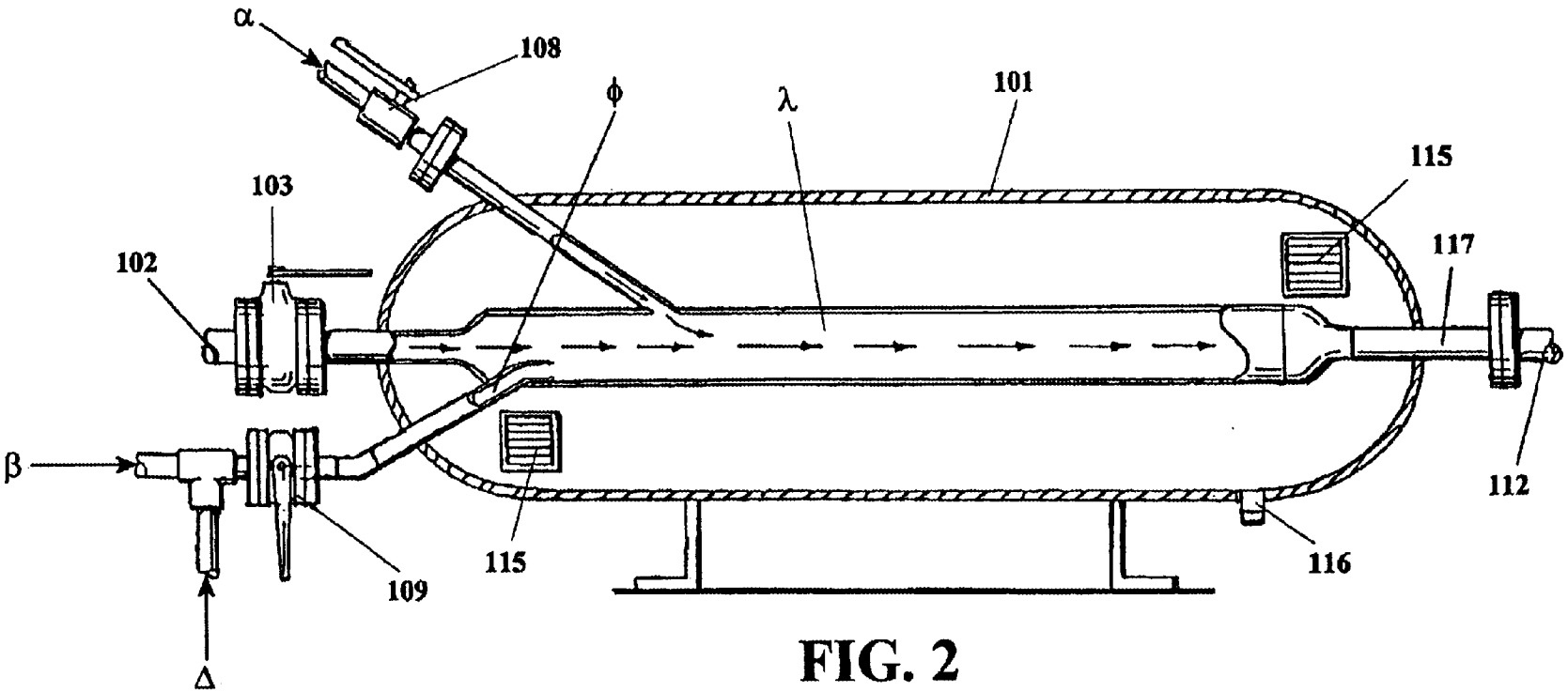
FIG. 2 shows a diametrical longitudinal cross section of another exemplary embodiment of a vapor evacuation device.
Figure 3A:
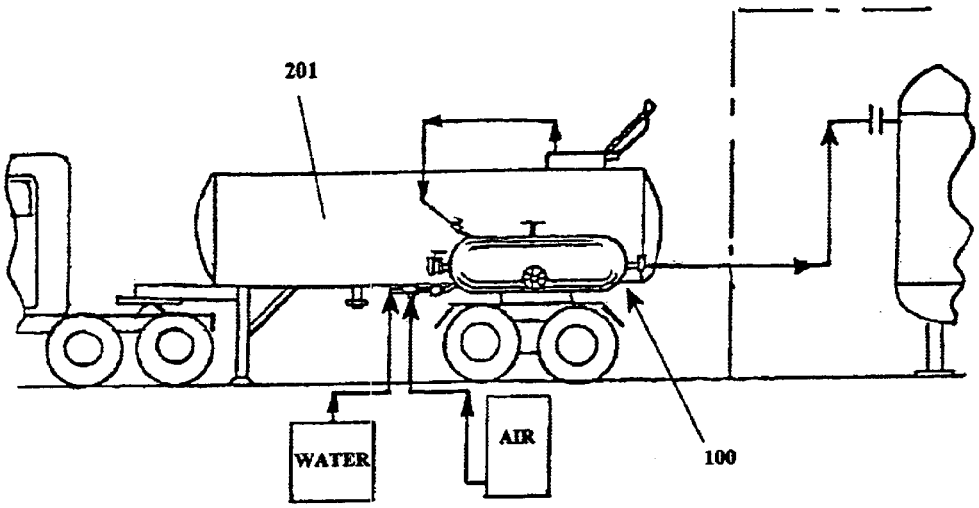
FIG. 3A shows an elevational view of a vapor evacuation device configured as part of a tanker truck.
Figure 3B:
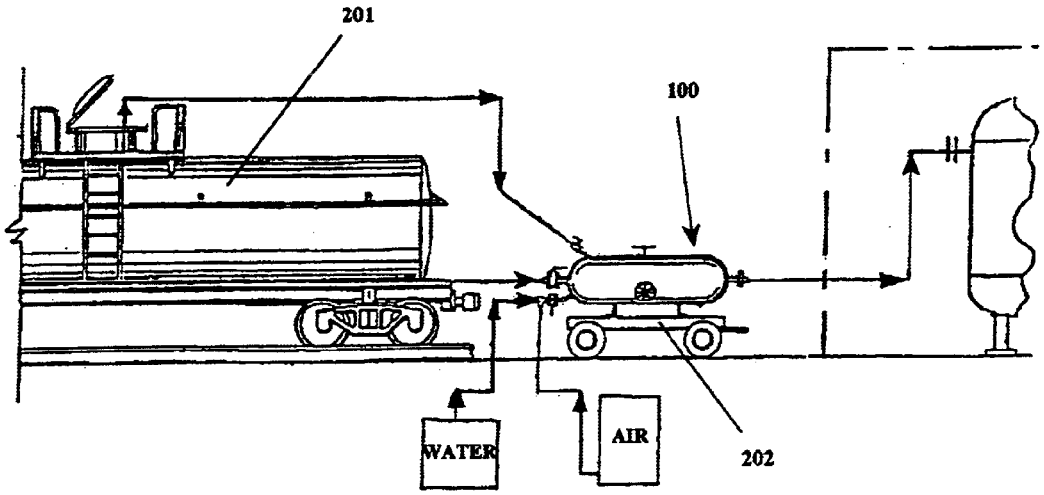
FIG. 3B shows an elevational view of a vapor evacuation device configured as a standalone trailer and in use with a rail tanker car.
Figure 4:
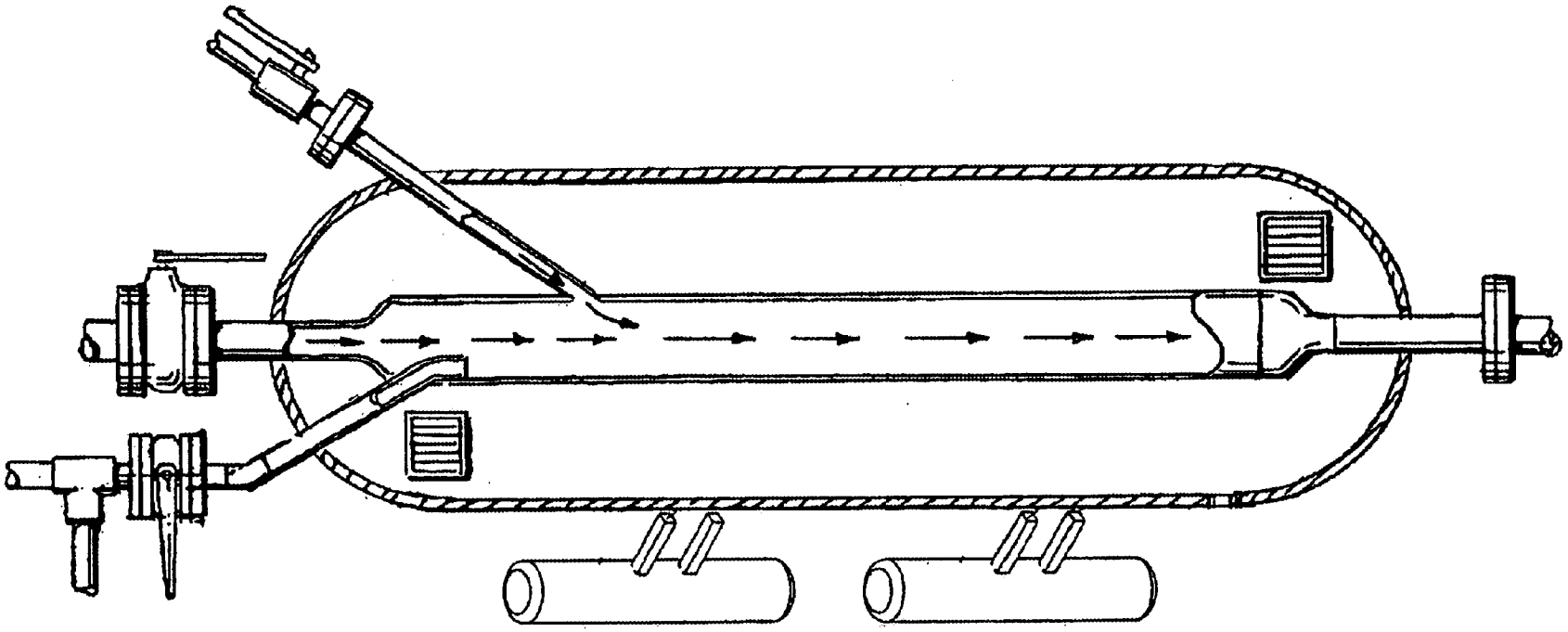
FIG. 4 shows an elevational view of a vapor evacuation device on a buoyant base.

Without any intent to limit the scope of this invention, reference is made to the figures in describing the various embodiments of the invention. Referring to FIGS. 1, 2 and 3, a vapor evacuation system 200 comprising:

1. A vapor containing vessel 201, which would contain gaseous or liquid chemicals or other products which will often leave vaporous residue in vessel 201 when evacuated;

2. A chassis 202 which may have wheels, skids, rails, tracks or any other mobility-creating device, the purpose of which is to enable the vessel to be moved around. Examples of such a chassis could be a trailer, a cart, a rail car, a sled or any similar device. The chassis might also be self-propelled, such as with a motor, sails or any method of locomotion. Examples of such a chassis would be a truck, a car, a locomotive, a van, or other vehicle. Alternately, the chassis can be buoyant, making a barge, boat or other seagoing vessel into a mobile, flotational vapor evacuation system 200; and
3. A vapor evacuation device 100 is provided for the removal of the vapors from vessel 201. An embodiment of such a vapor evacuation device 100 is illustrated in FIG. 1, comprising an outer housing 101 which may be used to protect and to conceal the inner workings of the device. In one embodiment, a fluid passageway 117 may consist of a first aperture 110 in which air $\Delta$ and/or water $\beta$ will be introduced into fluid passageway 117 creating a mixture $\phi$. A second aperture 112 will be located downstream of said first aperture 110 and may be connected to a wastewater line or other such disposal outlet. A third aperture 107 is connected to a vapor source, for example, the vapor vent of a tanker truck or other vessel 201.

Operation may be achieved in multiple ways, one of which can be to feed a fluid comprised of air $\Delta$ or water $\beta$, or some mixture thereof, into first aperture 110 to cause a vacuum at third aperture 107 which, in turn, draws vapors a out of vessel 201 and into fluid passageway 117 where vapors are combined with the air/water mixture $\phi$ to create a disposable vapor and air/water mixture $\lambda$. This effect is explained by the Bernoulli principle, which describes the phenomenon that when the flow rate of a fluid increases, the pressure within that fluid decreases. The net effect of a lower pressure within the fluid and a higher pressure within vessel 201 is a vacuum at third aperture 107, which increases proportionately to the flow rate within the vapor evacuation device. It is this pressure differential which causes vapors to flow from vessel 201 to fluid passageway 117. Vapor and air/water mixture $\lambda$ is subsequently expelled through second aperture 112 for disposal. Various valves can be used, such as first valve 109 to open and close fluid passageway 117 and second valve 104 configured to open and close the fluid passageway 117 downstream of said third aperture 107.

Another method of operation can be achieved by using pump 113 to increase the flow rate of material through the fluid passageway 117 which will further lower the fluid pressure and thus increase the vacuum at third aperture 107 which draws vapors $\alpha$ out of the vessel 201. This method can also be used when there is no source of air $\Delta$ present to mix with the water $\beta$ at first aperture 110 which would otherwise cause accelerated flow of fluid through fluid passageway 117. Here, pump 113 is used to increase the flow of fluid through fluid passageway 117, rather than using air $\Delta$, to accomplish a similar result. Air $\Delta$ can also be used with water $\beta$ in conjunction with pump 113.

Another embodiment of this invention can have multiple lines, such as a first line 105 and a second line 106 as in FIG. 1, wherein basic operation is the same as described above, only with the ability to select between the two lines 105 and 106 for evacuating the vapors, which allows for the selective use of pump 113.

The progress of the moving product through the assembly can be monitored by operatively affixing a sight glass 114 in line 105 and/or 106 so that the moving product can be viewed. This is useful for confirming that product is or is not moving through the apparatus as desired. The tank may also be configured to have vents 115 so that the internal temperature can be passively regulated, or fans or other circulation devices may be provided to actively control the temperature. This may be useful to keep pump 113 at a particular operating temperature or to prevent it from overheating. Additionally, a drain 116 may be mounted in the wall of the housing to permit evacuation of condensation or other liquid inside of the assembly that may result from operation, as a build up of such liquid may cause corrosion or other problems if permitted to accumulate.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

The invention claimed is:

1. A vapor evacuation device for removing vapors from a vessel comprising:

A fluid passageway having a first aperture configured to permit the introduction of a fluid into said fluid passageway, said fluid passageway further comprising a second aperture positioned downstream from said first aperture, whereby fluid entering said passageway will flow from said first aperture toward said second aperture, said fluid passageway further comprising a third aperture configured to provide fluid communication between said vessel and said fluid passageway, whereby fluid flowing from said first aperture toward said second aperture will draw vapors from said vessel into said fluid passageway, said vapor evacuation device further comprising a mobile chassis upon which said vapor evacuation device is mounted.

2. A vapor evacuation device according to claim 1 wherein said fluid is selected from the group comprising air, water and combinations thereof.

3. A vapor evacuation device according to claim 2 further comprising a pump configured to increase the rate of flow of fluid through said fluid passageway.

4. A vapor evacuation device according to claim 3 further comprising a sight glass positioned downstream from said pump, said sight glass configured to provide a view of the contents of said fluid passageway.

5. A vapor evacuation device according to claim 4 further comprising a first valve to open and close said fluid passageway operatively configured at said first aperture, said fluid passageway further comprising a second valve operatively configured to open and close said fluid passageway downstream of said third aperture.

6. A vapor evacuation device according to claim 5 further comprising a housing substantially enclosing said vapor evacuation device.

7. A vapor evacuation device according to claim 6 further comprising vents positioned in said housing to permit the flow of air in and out of said housing.

8. A vapor evacuation device according to claim 7 further comprising a drain positioned to permit liquid that may become trapped within said housing to drain therefrom.

9. A vapor evacuation device according to claim 8 wherein said mobile chassis comprises a frame and a plurality of wheels operatively connected thereto.

10. A vapor evacuation system comprising:

a. a mobile chassis;

b. a vessel mounted on said chassis; and c. a vapor evacuation device mounted on said chassis for removing vapors from said vessel, said vapor evacuation device comprising a fluid passageway having a first aperture configured to permit the introduction of a fluid into said fluid passageway, said fluid passageway further comprising a second aperture positioned downstream from said first aperture, whereby fluid entering said passageway will flow from said first aperture toward said second aperture, said fluid passageway further comprising a third aperture configured to provide fluid communication between said vessel and said fluid passageway, whereby fluid flowing from said first aperture toward said second aperture will draw vapors from said vessel into said fluid passageway.

11. A vapor evacuation device according to claim 10 wherein said fluid is selected from the group comprising air, water and combinations thereof.

12. A vapor evacuation system according to claim 11 wherein said vapor evacuation device further comprises a pump configured to increase the flow rate of fluid through said fluid passageway.

13. A vapor evacuation system according to claim 12 further comprising a sight glass positioned downstream from said pump, said sight glass configured to provide a view of the contents of said fluid passageway.

14. A vapor evacuation device according to claim 13 further comprising a first valve to open and close said fluid passageway operatively configured at said first aperture, said fluid passageway further comprising a second valve operatively configured to open and close said fluid passageway downstream of said third aperture.

15. A vapor evacuation system according to claim 14 further comprising a housing substantially enclosing said vapor evacuation device.

16. A vapor evacuation system according to claim 15 further comprising vents positioned in said housing to permit the flow of air in and out of said housing.

17. A vapor evacuation device according to claim 16 further comprising a drain positioned to permit liquid that may become trapped within said housing to drain therefrom.

18. A vapor evacuation system comprising:

a. a buoyant base;

b. a vessel mounted on said buoyant base; and c. a vapor evacuation device mounted on said buoyant base, said vapor evacuation device comprising a fluid passageway having a first aperture configured to permit the introduction of a fluid into said fluid passageway, said fluid passageway further comprising a second aperture positioned downstream from said first aperture, whereby fluid entering said passageway will flow from said first aperture toward said second aperture, said fluid passageway further comprising a third aperture configured to provide fluid communication between said vessel and said fluid passageway, whereby fluid flowing from said first aperture toward said second aperture will draw vapors from said vessel into said fluid passageway.

19. A vapor evacuation device according to claim 18 wherein said fluid is selected from the group comprising air, water and combinations thereof.

20. A vapor evacuation system according to claim 19 wherein said vapor evacuation device further comprises a pump configured to increase the rate of flow of fluid through said fluid passageway.

21. A vapor evacuation system according to claim 20 further comprising a pump configured along said fluid passageway.

22. A vapor evacuation system according to claim 21 further comprising a sight glass positioned downstream from said pump said sight glass configured to provide a view of the contents of said fluid passageway.

23. A vapor evacuation device according to claim 22 further comprising a first valve to open and close said first line configured upstream of said pump, said second line further comprising a second valve configured to open and close second line downstream of said third aperture.

24. A vapor evacuation system according to claim 23 further comprising a housing substantially enclosing said vapor evacuation device.

25. A vapor evacuation system according to claim 24 further comprising vents positioned in said housing to permit the flow of air in and out of said housing.

26. A vapor evacuation device according to claim 25 further comprising a drain positioned to permit liquid that may become trapped within said housing to drain therefrom.

27. A vapor evacuation device according to claim 26 further comprising a vent operatively configured in said fluid passageway to permit the escape of pressure and fluid in said vapor evacuation device into said housing.

28. A vapor evacuation device for removing vapors from a vessel comprising a vapor evacuation device comprising a fluid passageway having first and second lines operatively connected to permit selective use, said first line comprising a first aperture configured to permit the introduction of a fluid selected from the group comprising air, water and combinations thereof into said fluid passageway, said fluid passageway further comprising a second aperture positioned downstream from said first aperture, whereby fluid entering said passageway will selectively flow from said first aperture through either said first or said second lines toward said second aperture, said second line further comprising a third aperture configured to provide fluid communication between said vessel and said fluid passageway, whereby fluid flowing from said first aperture toward said second aperture will draw vapors from said vessel into said fluid passageway.

29. A vapor evacuation system according to claim 27 further comprising a pump configured to increase the rate of flow of fluid through said fluid passageway.

30. A vapor evacuation system according to claim 29 wherein said pump is configured along said first line.

31. A vapor evacuation system according to claim 30 further comprising a sight glass positioned downstream from said pump, said sight glass configured on said first line to provide a view of the contents of said fluid passageway.

32. A vapor evacuation device according to claim 31 further comprising a first valve to open and close said first line configured upstream of said pump, said second line further comprising a second valve configured to open and close second line downstream of said third aperture.

33. A vapor evacuation system according to claim 32 further comprising a housing substantially enclosing said vapor evacuation device.

34. A vapor evacuation system according to claim 33 further comprising vents positioned in said housing to permit the flow of air in and out of said housing.

35. A vapor evacuation system according to claim 34 further comprising a drain positioned to permit the draining of said housing of any liquid that may become trapped within said housing.

36. A vapor evacuation device according to claim 27 wherein said vent is a series of perforations in said fluid passageway.

37. A method of evacuating vapors from a vessel using a vapor evacuation device comprising: a fluid passageway having a first aperture configured to permit the introduction of a fluid into said fluid passageway, said fluid passageway further comprising a second aperture positioned downstream from said first aperture, whereby fluid entering said passageway will flow from said first aperture toward said second aperture, said fluid passageway further comprising a third aperture configured to provide fluid communication between said vessel and said fluid passageway, whereby fluid flowing from said first aperture toward said second aperture will draw vapors from said vessel into said fluid passageway, and wherein said vapor evacuation device is mounted on a mobile chassis, comprising: passing fluid selected from the group comprising air, water and combinations thereof through said fluid passageway whereby the flow of fluid through said passageway will draw said vapors from said vessel through said aperture into said passageway.

38. A method of evacuating vapors from a vessel according to claim 37 further comprising combining said vapors with said fluid.

39. A method of evacuating vapors from a vessel according to claim 37 further comprising pumping said fluid through said fluid passageway to increase the flow rate of said fluid.

40. A method of evacuating vapors from a vessel according to claim 37 wherein said vapor evacuation device further comprises:

1. a first valve in said fluid passageway operatively configured to open and close said fluid passageway at said first aperture;
2. a housing substantially enclosing said vapor evacuation device; and
3. a vent operatively configured to permit the release of fluid and gas from said housing, and wherein said fluid is permitted to flow from said fluid passageway through said second aperture into said housing, at which point said first valve is closed, trapping said fluid in said fluid passageway and said housing, permitting said vapors from said third aperture to flow into said trapped fluid.

41. A method of evacuating vapors from a vessel according to claim 40 wherein said second aperture is a series of perforations in said fluid passageway.

42. A vapor evacuation device for removing vapors from a vessel comprising:

1. a fluid passageway comprising
   a. A first aperture configured to permit the introduction of a fluid into said fluid passageway;
   b. a second aperture positioned downstream from said first aperture, whereby fluid entering said passageway will flow from said first aperture toward said second aperture;
   c. a third aperture configured to provide fluid communication between said vessel and said fluid passageway; and
2. a housing enclosing a substantial portion of said fluid passageway.

43. A vapor evacuation device according to claim 42 wherein said second aperture is a series of perforations in said fluid passageway, permitting said fluid to be introduced into said housing.

44. A vapor evacuation device according to claim 43 further comprising a valve operatively configured at said first aperture to control to flow of fluid in and out of said fluid passageway.

45. A vapor evacuation device according to claim 44 wherein said vapor evacuation device is mounted upon a mobile chassis.

* * * * *